US007115829B2

(12) United States Patent
Schmid

(10) Patent No.: US 7,115,829 B2
(45) Date of Patent: Oct. 3, 2006

(54) SWITCH

(75) Inventor: Johannes Schmid, Vienna (AT)

(73) Assignee: Moeller Gebäudeautomation KG, Schrems (AT)

( * ) Notice: Subject to any disclaimer, the term of this patent is extended or adjusted under 35 U.S.C. 154(b) by 175 days.

(21) Appl. No.: 10/942,242

(22) Filed: Sep. 16, 2004

(65) Prior Publication Data

US 2005/0061648 A1 Mar. 24, 2005

Related U.S. Application Data

(60) Provisional application No. 60/505,311, filed on Sep. 23, 2003.

(30) Foreign Application Priority Data

Sep. 23, 2003 (AT) ..... 1504/2003

(51) Int. Cl.
*H01H 5/00* (2006.01)

(52) U.S. Cl. ..... 200/400; 200/401

(58) Field of Classification Search ..... 200/400, 200/401, 424–431, 434, 449–454, 321–325, 200/318; 335/8–10, 16, 147, 195, 167, 200
See application file for complete search history.

(56) References Cited

U.S. PATENT DOCUMENTS

| | | | | |
|---|---|---|---|---|
| 3,867,598 | A * | 2/1975 | Richards et al. | 200/449 |
| 4,262,179 | A * | 4/1981 | Bauer | 200/250 |
| 4,641,001 | A * | 2/1987 | Fujihisa et al. | 200/401 |
| 4,760,226 | A * | 7/1988 | Fasano | 200/303 |
| RE33,325 | E * | 9/1990 | Yokoyama et al. | 335/14 |
| 5,300,906 | A | 4/1994 | Blanchard et al. | |
| 6,013,889 | A * | 1/2000 | Wieloch | 218/22 |
| 6,456,176 | B1 * | 9/2002 | Fujihira et al. | 335/6 |
| 6,492,607 | B1 * | 12/2002 | Bruckert et al. | 200/401 |
| 6,870,115 | B1 * | 3/2005 | Slepian | 200/401 |

FOREIGN PATENT DOCUMENTS

| | | |
|---|---|---|
| DE | 25 48 723 | 5/1977 |
| DE | 29 01 246 | 8/1979 |
| DE | 28 46 213 | 5/1980 |
| DE | 36 39 166 A1 | 5/1988 |
| DE | 40 14 191 A | 1/1991 |
| DE | 198 18 058 A1 | 11/1999 |
| EP | 0 897 186 A1 | 2/1999 |
| EP | 1 054 421 A | 11/2000 |

* cited by examiner

*Primary Examiner*—Michael A. Friedhofer
(74) *Attorney, Agent, or Firm*—Henry M. Feiereisen

(57) ABSTRACT

A switch includes a contact mechanism having at least one contact and defining a longitudinal axis. Actuation of a handle moves the contact mechanism transversely to the longitudinal axis between an open position and a closed position in relation to at least one fixed contact, whereby a contact spring loads the contact mechanism to seek the closed position. A support part is operatively connected to the handle and forms an abutment for support of the contact spring. The support part is moveable relative to the contact mechanism. Operated by the handle is a locking mechanism which is constructed to hold the contact mechanism in an intermediate position between the open and closed positions to maintain the contact of the contact mechanism at an electrically insulated distance from the fixed contact. A release mechanism interacts with the locking device for releasing the contact mechanism to move to the closed position.

15 Claims, 6 Drawing Sheets

2
14
15
6
7
33
3
5
72
32
11
10
9
32
36
4
12
31
30
35
8
8a
13
14
15

SWITCH

CROSS-REFERENCES TO RELATED APPLICATIONS

This application claims the benefit of prior filed U.S. provisional Application No. 60/505,311, filed Sep. 23, 2003, pursuant to 35 U.S.C. 119(e), the disclosure of which is incorporated herein by reference.

This application also claims the priority of Austrian Patent Application, Serial No. A 1504/2003, filed Sep. 23, 2003, pursuant to 35 U.S.C. 119(a)–(d).

BACKGROUND OF THE INVENTION

The present invention relates, in general, to the field of electric switches.

Nothing in the following discussion of the state of the art is to be construed as an admission of prior art.

European Patent Publication No. EP 1 054 421 discloses a switch which has a toggle joint system for connecting a handle with a contact bridge, whereby the joint of the toggle joint system is guided in a slot and is acted upon by a spring. The slot has a substantially triangular configuration for passage of the joint and is thus relative complicated in structure in order to attain a closing speed of the contact bridge in substantial independent relationship to the speed of operation of the handle. The closing speed of the contact bridge is hereby relatively small and the buildup of a sufficient contact pressure during closing of the contacts is relatively slow. This slow buildup of contact pressure poses a problem, when greater currents and higher inductive loads are involved, because switches of this type have then a tendency to fuse the contacts, resulting eventually in a destruction of the switch.

It would therefore be desirable and advantageous to provide an improved switch which obviates prior art shortcomings and which is suitable for use in switching of greater currents, without experiencing a risk of contact fusing, in particular during switching of highly inductive loads, such as, e.g., motors, while being simple in structure.

SUMMARY OF THE INVENTION

According to one aspect of the present invention, a switch includes a contact mechanism having at least one contact and defining a longitudinal axis, a handle for moving the contact mechanism transversely to the longitudinal axis between an open position and a closed position in relation to at least one fixed contact, a contact spring loading the contact mechanism to seek the closed position, a support part which is operatively connected to the handle and forming an abutment for support of the contact spring and which is moveable relative to the contact mechanism, a locking mechanism controllable by the handle and constructed to hold the contact mechanism in an intermediate position between the open and closed positions to maintain the contact of the contact mechanism at an electrically insulated distance from the fixed contact, and a release mechanism interacting with the locking device for releasing the contact mechanism to move to the closed position.

In accordance with the present invention, actuation of the handle in direction of the closing position effects a movement of the support part in direction of the closing position, while the contact bridge is conjointly moved. When a certain intermediate position has been reached, a further movement of the contact bridge is prevented by the locking device, and the contact spring is tensioned as the handle is moved further. When the locking device is released, the contact bridge is thus moved rapidly against the fixed contact by the tensed contact spring, so that contact pressure can be built up very quickly.

According to another feature of the present invention, the contact mechanism may include a contact slide having a projection, and a contact bridge which is held in the contact slide and includes the contact, wherein the locking mechanism includes a detent interacting with the projection, when the contact mechanism occupies the intermediate position. In this way, the switch is simple in structure. Suitably, the contact slide may be made of an electrically insulating material.

According to another feature of the present invention, the handle may be constructed for rotation between two end positions along a movement path, wherein the support part is guided in a recess of the contact slide, and a bar is provided for connecting the support part with the handle. In this way, a rotational movement of the handle is converted in a simple manner into a translational movement, with the support part being guided in the contact slide.

According to another feature of the present invention, the release mechanism may include a lobe formed on the handle, wherein the detent is configured as a swingable angle lever having one arm interacting with the lobe, and with another arm formed with a hook-shaped end for interacting with a projection of the contact slide to maintain the contact mechanism in the intermediate position and maintaining the contact spring under tension. In this way, a very secure form-fitting locking of the movement of the contact slide is realized. The use of an angle lever permits hereby a very compact configuration of the detent which can easily be released by the lobe of the handle.

According to another feature of the present invention, an engagement mechanism can be provided for connecting the support part with the contact slide. This ensures a control of the contact slide by the handle, whereby a mutual displacement of the support part in relation to the contact slide is possible within certain limits. Suitably, the engagement mechanism may include at least one stop formed on the contact slide for abutment by the support part under tension of the contact spring, when the contact mechanism assumes the open position.

According to another feature of the present invention, the locking mechanism may be constructed to inhibit a movement of the contact slide, when the contact slide moves in direction of the closing position and the handle is moved by about a third of the movement path, so that a further movement of the handle results only in a displacement of the support part in opposition to the force of the contact spring, whereby the locking mechanism can be released when the handle is moved approximately by half of the movement path.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
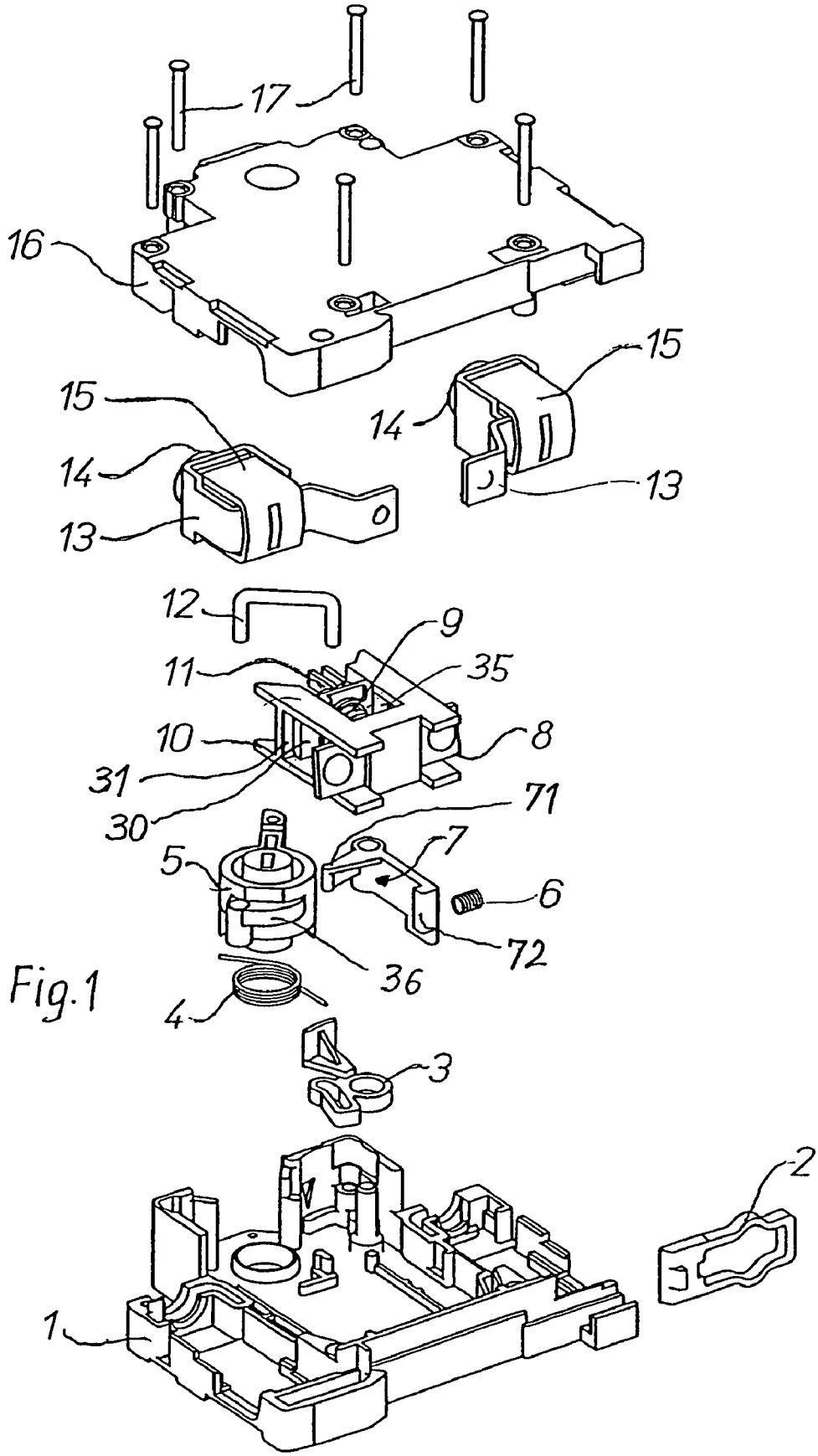
FIG. 1 shows an explosive illustration of a switch according to the invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown an explosive illustration of a switch according to the invention, having a bottom shell 1 in which a contact slide 10 is guided which holds a contact bridge 8. The bottom shell 1 interacts with a top shell 16 to form together a casing, with both shells 1, 16 being connected with one another via fastening elements 17, e.g. hollow rivets. Swingably held in this casing 1, 16 is a handle 5 which is acted upon by a torsion spring 4. A pointer 3 is further held swingably in the casing 1, 16 for displaying the switching state of the switch.

Further held in the casing 1, 16 are connection angles 13 with contacts 32, clamping screws 14 and terminals 15 for connection of wires. Further provided for the contact slide 10 is a locking device 7 which is loaded by a spring 6 to seek the locking position. The locking device 7 is configured in the form of a detent shaped as a two-armed angle lever which is rotatable about a joint 7*a* and has one arm 71 for interaction with a lobe 36 of the handle 5, and another arm 72 which terminates in a hook-shaped end.

Movably held in the contact slide 10 is a support part 11 for a contact spring 9. The support part 11 is hereby coupled with the handle 5 via a U-shaped bar 12. The casing 1, 16 of the switch is secured by providing a locking slide 2 which enables a fastening of the casing 1, 16 to a common rail.

Figure 6:
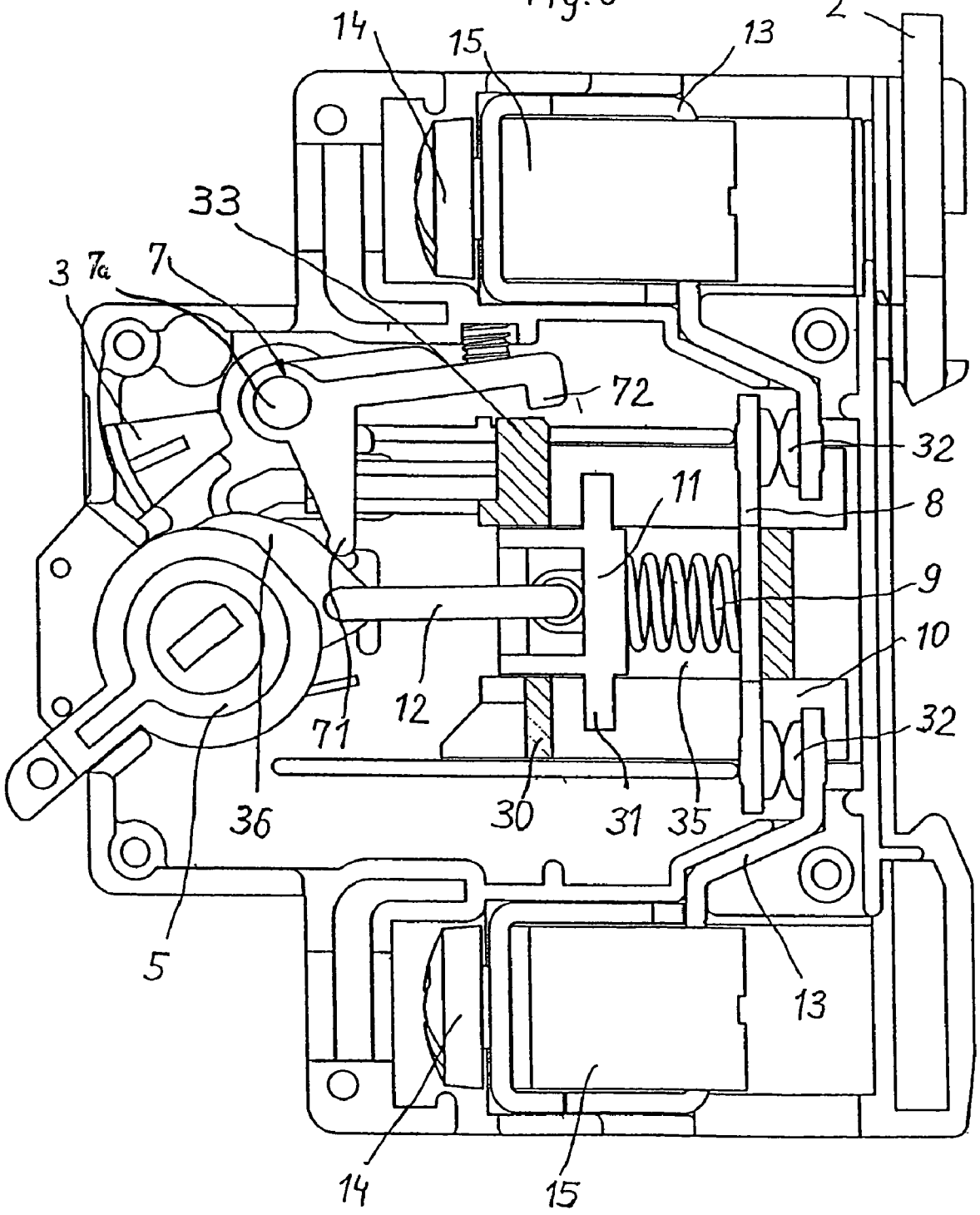
FIG. 6 is a schematic illustration of the switch in closed position.

The support part 11 has lateral arms 30 which rest upon stops 31 of the contact slide 10 as a consequence of the pretension of the contact spring 9 (FIG. 2), although it is possible to detach the support part 11 and its arms 30 from the stops 31 by increasing the pretension of the contact spring 9. (FIG. 6). Hereby, the contact slide 10 may be moved by the support part 11, which is coupled via the U-shaped bar 12 with the handle 5.

Figure 2:
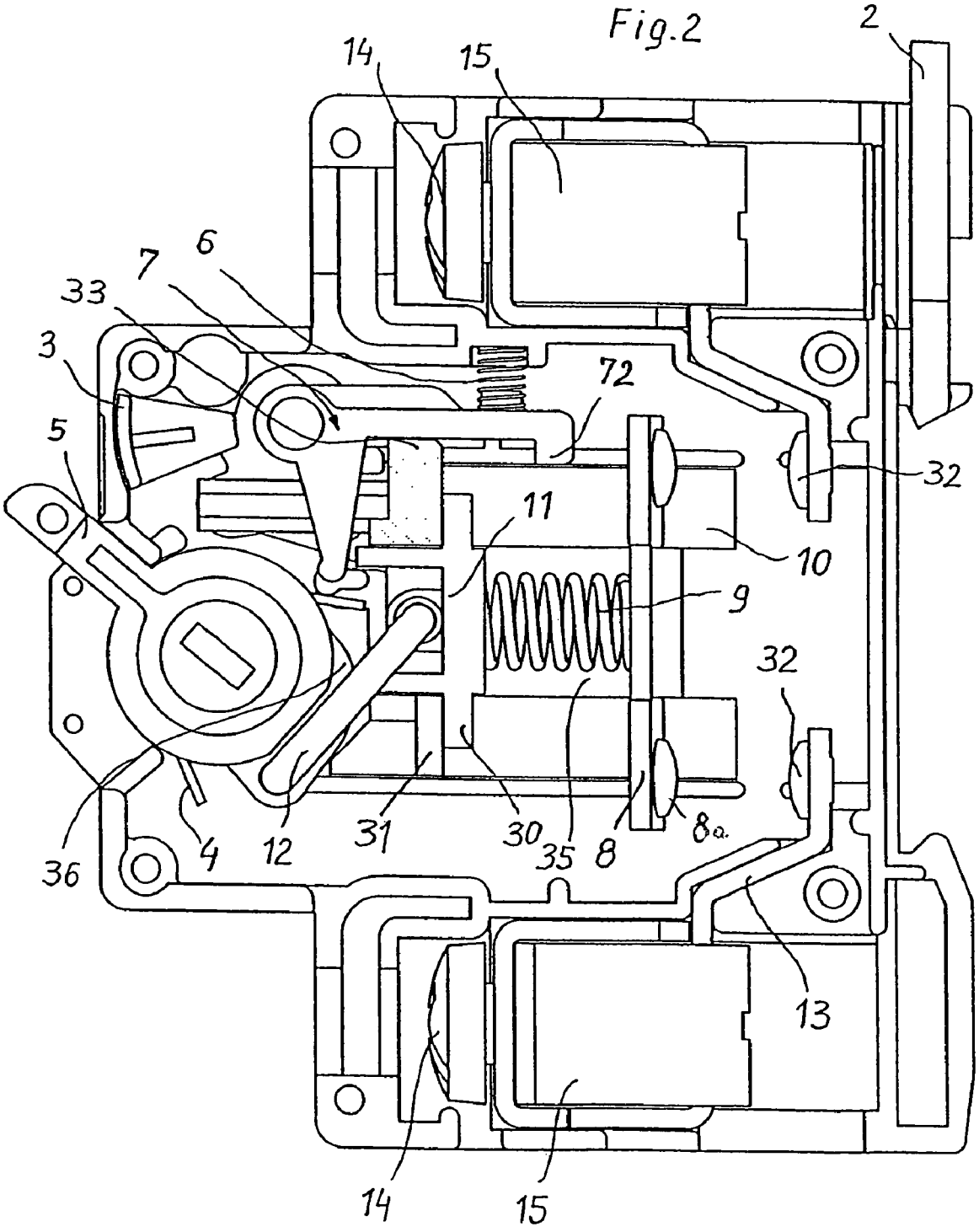
FIG. 2 is a schematic illustration of the switch in an open position.

As shown in FIG. 2, the contact spring 9 is only slightly under tension when the switch is open. However, the remaining tension of the contact spring 9 ensures a securement of the contact slide 10 in its one end position, whereby the support part 11 bears with its lateral arms 30 upon the stops 31 of the contact slide 10. The contact bridge 8 is hereby detached at a maximum from the connection angles 13 including fixed contacts 32, and, as a result of the pretension of the spring 6, the locking device 7 occupies the locking position which, however, is ineffective, when the contacts are fully open.

Figure 3:
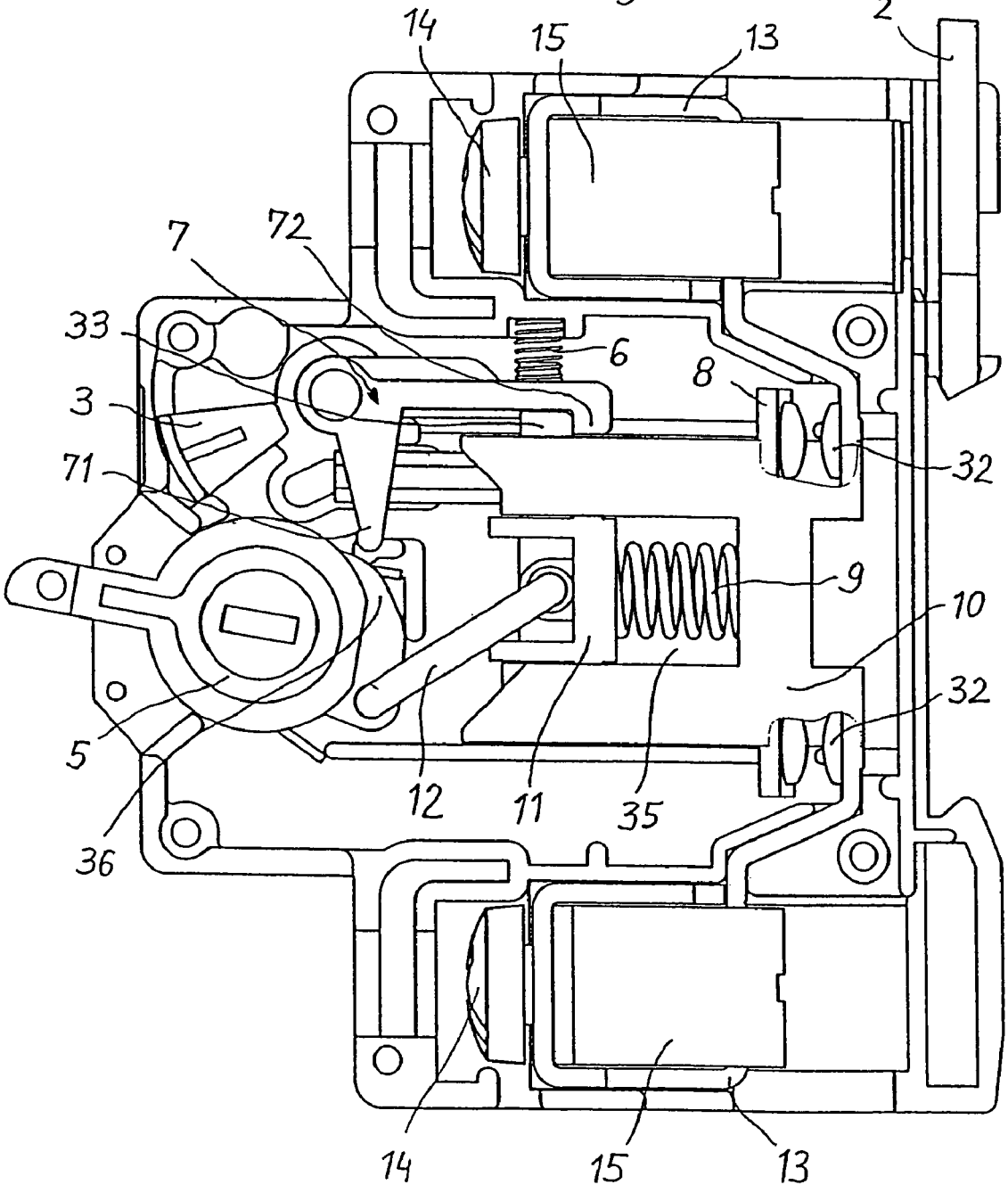
FIG. 3 is a schematic illustration of the switch in one intermediate position.

In the intermediate position of the switch, as shown in FIG. 3, the handle 5 is pivoted by an angle of about 30° to move the contact bridge 8 in the direction of the fixed contacts 32. The total angle by which the handle 5 can be rotated is about 90°. In this intermediate position of the handle 5, the contact slide 10 has moved via the linkage comprised of U-shaped bar 12, support part 11 for the contact spring 9 and the contact spring 9 itself, in the direction of the fixed contacts 32 which are held on the connection angles 13. As a result, a projection 33, extending out from the contact slide 10, impacts against the hook-shaped end of arm 72 of the locking device 7. Thus, the contact slide 10 is prevented from moving in the direction of the fixed contacts 32, while the contacts 8*a* of the contact bridge 8 are still held at a distance to the fixed contacts 32 of the connection angles 13.

At the same time, the pointer 3 is also pivoted to initiate in a viewing window of the casing 1, 16 the display of a color that indicates the closing position of the switch.

Figure 4:
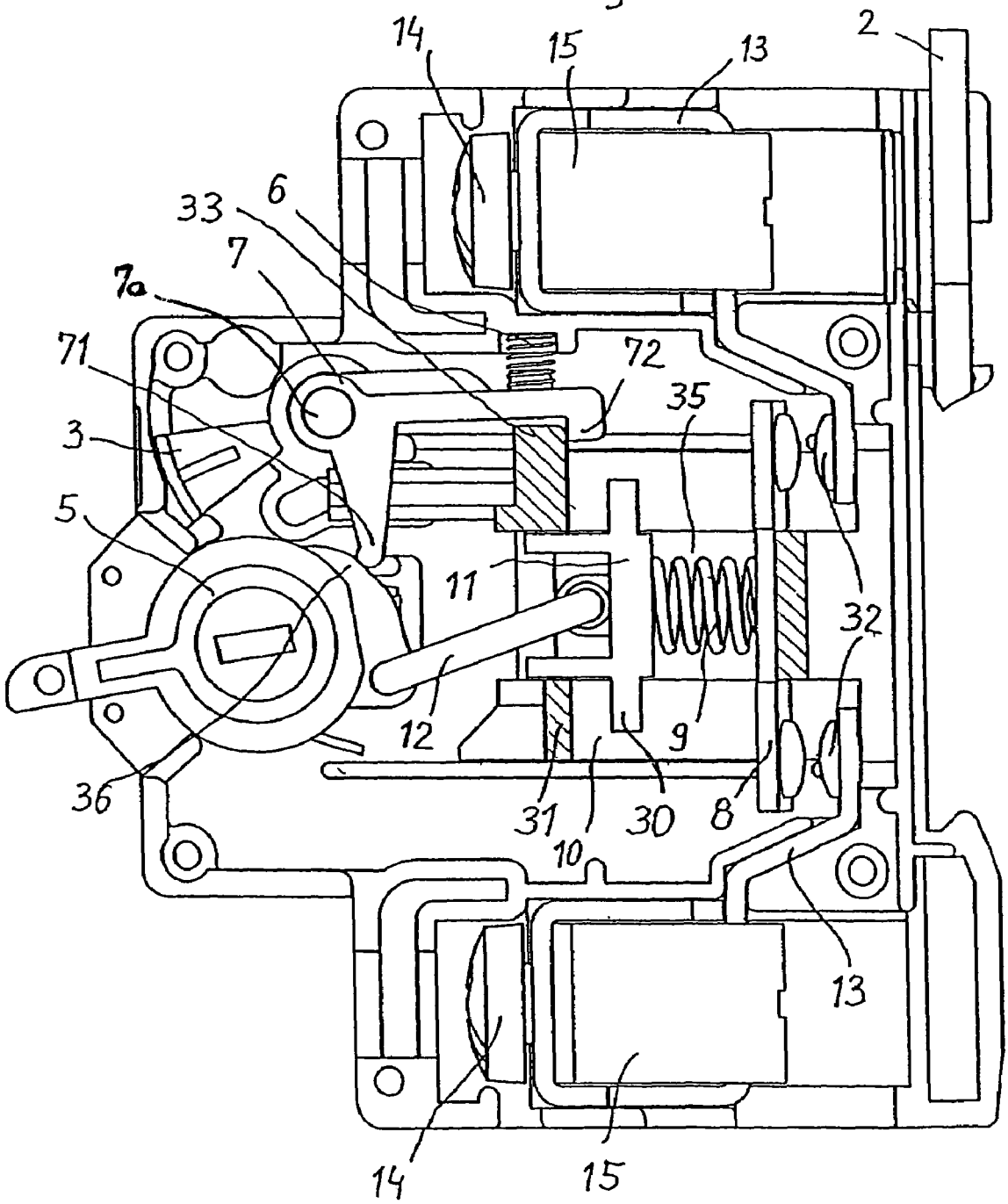
FIG. 4 is a schematic illustration of the switch in a further intermediate position.

FIG. 4 shows the handle 5 in a position which, compared to FIG. 3, is further advanced in closing direction. As the contact slide 10 is held in place by the locking device 7, only the support part 11 is now moved translatory to the right to further compress the contact spring 9, thereby increasing the pretension of the contact spring 9. The support part 11 is guided hereby in a recess 35 (FIG. 5) of the contact slide 10 for movement relative to the contact slide 10.

As the handle 5 is moved further toward its other end position, the arm 71 of the locking device 7 is deflected by the lobe 36 of the handle 5. Thus, the locking device 7 pivots about the joint 7*a*, and the hook-shaped end of arm 72 releases the lateral projection 33 of the contact slide 10. (FIG. 6). As a result, the pretension of the contact spring 9 accelerates the contact slide 10 and thus also the contact bridge 8, thereby very rapidly building up the contact pressure when the contact bridge 8 impacts the fixed contacts 32 of the connection angles 13 so that the risk of fusion of the contacts is prevented even when high current are to be switched and significant inductive loads are involved.

Figure 5:
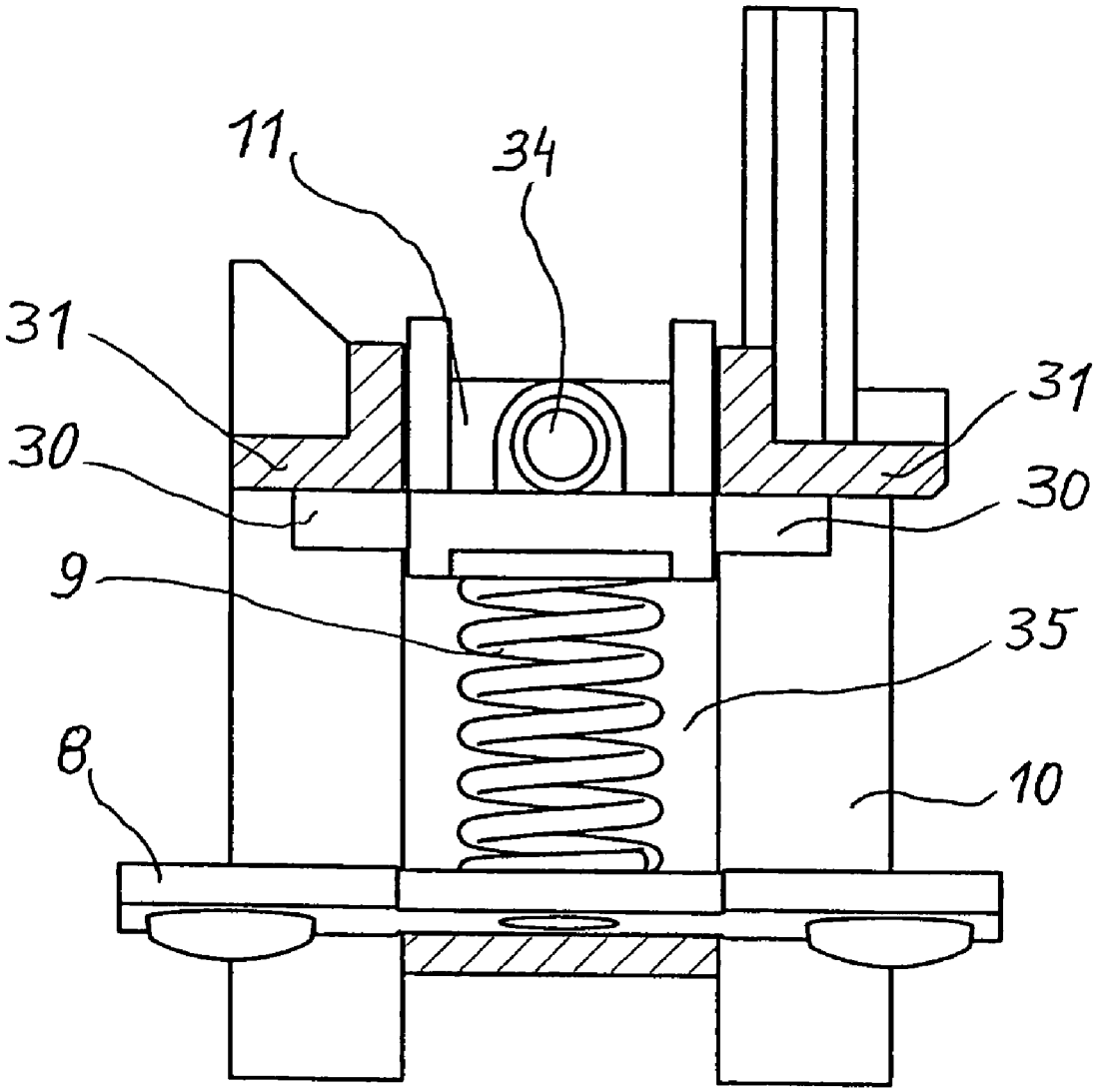
FIG. 5 is a cutaway view of the switch, showing in detail a contact slide with a support part of a contact spring.

FIG. 5 shows in detail the contact slide 10 and the support part 11 including contact spring 9. The support part 11 supports one end of the contact spring 9, the other end of which rests against the contact bridge 8. The support part 11 is provided with a bore 34 for engagement by a leg of the U-shaped bar 12 and is guided in the recess 35 of the contact slide 10 for movement between two end positions. One end position is hereby established by the lateral arms 30 (FIGS. 1, 5) of the support part 11 and the stops 31 of the contact slide 10, and the other end position is defined by the maximum compression of the contact spring 9.

As shown in FIG. 6, the U-shaped bar 12 extends in closing position of the switch in substantial parallel relationship to the axis of the contact spring 9 and to the movement direction of the support part 11, although a slight over dead center position may be provided.

When the handle 5 is moved back in the direction of a position corresponding to the open position of the switch, as shown in FIG. 2, the contact pressure decreases and the contact spring 9 relaxes until the support part 11 with its lateral arms 30 impact the stops 31 of the contact sleeve 10. In further continuance, the contact slide 10 is moved by the support part 11 and the contacts 8*a* of the contact bridge 8 detach from the fixed contacts 32. As a consequence of the pretension of the contact spring 9, this process is implemented very rapidly as the contact spring 9 assists the movement of the handle 5, whereas the force of the contact spring 9 must be overcome, when the handle 5 moves in direction of the position corresponding to the closing position of the switch. The locking device 7, however, imposes a bounce behavior when the switch closes, thereby ensuring a very rapid buildup of the contact pressure.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby, enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A switch, comprising:

a contact mechanism having at least one contact and defining a longitudinal axis;

a handle for moving the contact mechanism transversely to the longitudinal axis between an open position and a closed position in relation to at least one fixed contact;

a contact spring loading the contact mechanism to seek the closed position;

a support part operatively connected to the handle and forming an abutment for support of the contact spring, said support part being moveable relative to the contact mechanism;

a locking mechanism controllable by the handle and constructed to hold the contact mechanism in an intermediate position between the open and closed positions to maintain the at least one contact of the contact mechanism at an electrically insulated distance from the fixed at least one contact; and a release mechanism interacting with the locking device for releasing the contact mechanism to move to the closed position.

2. The switch of claim 1, wherein the contact mechanism includes a contact slide having a projection, and a contact bridge which is held in the contact slide and includes the at least one contact, said locking mechanism including a detent interacting with the projection when the contact mechanism occupies the intermediate position.

3. The switch of claim 2, wherein the contact slide is made of electrically insulating material.

4. The switch of claim 3, wherein the locking mechanism is constructed to inhibit a movement of the contact slide, when the contact slide moves in direction of the closing position and the handle is moved by about a third of the movement path, so that a further movement of the handle results only in a displacement of the support part in opposition to the force of the contact spring, said locking mechanism being released when the handle is moved approximately by half of the movement path.

5. The switch of claim 2, wherein the handle is constructed for rotation between two end positions along a movement path, said support part guided in a recess of the contact slide, and further comprising a bar for connecting the support part with the handle.

6. The switch of claim 5, wherein the bar is U-shaped having two parallel legs, with one leg connected to the handle and the other leg connected to the support part.

7. The switch of claim 2, wherein the release mechanism includes a lobe formed on the handle, said detent being configured as a swingable angle lever having one arm interacting with the lobe, and with another arm formed with a hook-shaped end configuration for interacting with a projection of the contact slide to maintain the contact mechanism in the intermediate position and maintaining the contact spring under tension.

8. The switch of claim 2, and further comprising an engagement mechanism for connecting the support part with the contact slide.

9. The switch of claim 8, wherein the engagement mechanism includes at least one stop formed on the contact slide for abutment by the support part under tension of the contact spring, when the contact mechanism assumes the open position.

10. A switch, comprising:

a handle;

a spring-biased contact mechanism having a contact intended for contacting a fixed contact in a closed position;

a linkage for so coupling the handle with the contact mechanism that the contact mechanism is moveable between an open position and the closed position; and a locking mechanism constructed to releasably hold the contact mechanism in an intermediate position between the open and closed positions to allow an increase of spring force upon the contact of the contact mechanism while maintaining the contact of the contact mechanism at a distance from the fixed contact.

11. The switch of claim 10, wherein the contact mechanism includes a first portion formed with a projection impacting the locking mechanism in the intermediate position, a second portion movably received in the first portion for movement between two end positions, and a spring extending between the second portion and the contact of the contact mechanism.

12. The switch of claim 11, wherein the linkage is a bar for connecting the handle with the second portion.

13. The switch of claim 11, wherein the locking mechanism is a rotatably mounted two-armed angle lever having one arm formed with a hooked end for interaction with the projection.

14. The switch of claim 11, wherein first portion has a stop for abutment by the second portion to thereby define one end position of the contact mechanism, said other end position being defined by a maximum compression capability of the spring.

15. The switch of claim 10, wherein the handle includes a lobe for releasing the locking mechanism from the contact mechanism to thereby move the contact mechanism at increased spring force against the fixed contact.

* * * * *